US006889909B2

(12) United States Patent
Kobayashi et al.

(10) Patent No.: US 6,889,909 B2
(45) Date of Patent: May 10, 2005

(54) EXPANSION VALVE

(75) Inventors: Kazuto Kobayashi, Tokyo (JP); Masamichi Yano, Tokyo (JP); Kazuhiko Watanabe, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/614,086

(22) Filed: Jul. 8, 2003

(65) Prior Publication Data

US 2004/0020996 A1 Feb. 5, 2004

(30) Foreign Application Priority Data

Jul. 23, 2002 (JP) ..... 2002-213380

(51) Int. Cl.[7] ..... F25B 41/04
(52) U.S. Cl. ..... 236/92 B; 62/225
(58) Field of Search ..... 62/225; 137/454.2; 236/92 B

(56) References Cited

U.S. PATENT DOCUMENTS

| | | | | |
|---|---|---|---|---|
| 2,508,010 A | | 5/1950 | Bower | |
| 3,388,864 A | | 6/1968 | Noakes | |
| 3,478,774 A | | 11/1969 | Noakes et al. | |
| 4,015,777 A | * | 4/1977 | Treder | 236/92 B |
| 5,060,485 A | * | 10/1991 | Watanabe et al. | 62/225 |
| 5,127,237 A | * | 7/1992 | Sendo et al. | 62/225 |
| 5,150,733 A | * | 9/1992 | Scaramucci | 137/454.2 |
| 5,555,739 A | * | 9/1996 | Kujirai et al. | 62/244 |
| 6,112,998 A | * | 9/2000 | Taguchi | 236/92 B |
| 6,386,221 B1 | * | 5/2002 | Knoll et al. | 137/15.21 |
| 6,626,365 B2 | * | 9/2003 | Kobayashi et al. | 236/92 B |

FOREIGN PATENT DOCUMENTS

| | | |
|---|---|---|
| EP | 0947786 A2 | 10/1999 |
| EP | 0959310 A2 | 11/1999 |
| EP | 1262698 A2 | 12/2002 |
| EP | 1262699 A2 | 12/2002 |
| GB | 1379549 | 1/1975 |
| JP | 05-322380 | 7/1993 |
| JP | 08-152232 A1 | 6/1996 |
| JP | 11-351440 A1 | 12/1999 |

OTHER PUBLICATIONS

European Search Report dated Dec. 19, 2003.

* cited by examiner

*Primary Examiner*—William E. Tapolcai
(74) *Attorney, Agent, or Firm*—Rader, Fishman & Grauer PLLC

(57) ABSTRACT

An expansion valve 1 comprises a piping member 10 having passages to which pipes for a refrigerant are connected, and a cassette unit 100, which are formed as separate components. The cassette unit 100 comprises a tube member 110 accommodating a guide member 170, an orifice member 180 and a plate member 166. A diaphragm 130 sandwiched between a rising portion 121 of a lid 120 and an end 110′*c* of the tube member 110 and defining a gas charge chamber 122 is displaced, the movement of which is transmitted to a shaft member 150. The shaft member 150 is guided by a guide member 170 and drives a valve member 160 disposed within a valve chamber 161. The cassette unit 100 is inserted to the piping member 10 and fixed by a ring 50. Seal members 62, 64, 66 are disposed to necessary areas.

14 Claims, 11 Drawing Sheets

EXPANSION VALVE

FIELD OF THE INVENTION

The present invention relates to an expansion valve for use in a refrigeration cycle of an air conditioner of a car or the like.

DESCRIPTION OF THE RELATED ART

For example, Japanese Patent Laid-Open No. 8-152232 discloses an expansion valve comprising an expansion valve body and a separately formed functional member containing a diaphragm chamber, wherein the expansion valve is formed by assembling this separately formed functional member to the valve body. Further, a spring is disposed within a temperature sensing case, enabling the length between the spring receiver to be controlled using a screw mechanism. A similar expansion valve structure is disclosed in Japanese Patent Laid-Open No. 11-351440.

According to the expansion valve disclosed in above-mentioned Japanese Patent Laid-Open No. 8-152232, the screw mechanism is equipped to the mounting portion of the temperature sensing case, and a screw mechanism is further utilized when fixing the body of the functional member to the valve body, by which the overall structure of the expansion valve becomes complex.

The object of the present invention is to provide an expansion valve comprising a piping member and a cassette unit provided with the functions of the expansion valve, so that the overall structure of the expansion valve can be simplified greatly.

SUMMARY OF THE INVENTION

The expansion valve according to the present invention equipped in an air conditioner to control the flow of a refrigerant comprises: a piping member with a refrigerant path to which is connected a pipe communicated with a device of the air conditioner; a cassette unit inserted to the piping member; the cassette unit comprising a tube member formed integrally with a flange member; a guide member, an orifice member and a plate member fixed to an interior of the tube member; a valve member disposed within a valve chamber defined by the orifice member; a plate member defining the valve chamber; a spring disposed between the plate member and the valve member and biasing the valve member toward the orifice member; a shaft member for driving the valve member; a lid member welded onto the flange member; a diaphragm sandwiched between the lid member and the flange member and defining a gas charge chamber; and a stopper for transmitting a displacement of the diaphragm to the shaft member; a ring for fixing to the piping member the lid member of the cassette unit inserted to the piping member; and a seal member disposed between an outer diameter of the cassette unit and an inner diameter of the piping member.

Further, the expansion valve according to the present invention equipped in an air conditioner to control the flow of a refrigerant comprises: a piping member with a refrigerant path to which is connected a pipe communicated with a device of the air conditioner; a cassette unit inserted to the piping member; the cassette unit comprising a tube member; a guide member, an orifice member and a plate member fixed to an interior of the tube member; a valve member disposed within a valve chamber defined by the orifice member; a plate member disposed at the lower end of the tube member and defining the valve chamber; a spring disposed between the plate member and the valve member and biasing the valve member toward the orifice member; a shaft member for driving the valve member; a lid member having a raised portion welded onto the tube member; a diaphragm sandwiched between the raised portion and the upper end of the tube member and defining a gas charge chamber; and a stopper for transmitting a displacement of the diaphragm to the shaft member; a ring for fixing to the piping member the lid member of the cassette unit inserted to the piping member; and a seal member disposed between an outer diameter of the cassette unit and an inner diameter of the piping member.

Furthermore, the axis of the refrigerant path formed to the piping member is designed according to the layout of the piping.

Even further, the expansion valve comprises a rubber bush disposed to the outside of the tube member, and a rubber seal member baked onto the outside of the tube member.

Moreover, the guide member, the orifice member and the plate member are caulked to the tube member.

DETAILED DESCRIPTION OF THE PREFERRED EMBODIMENT

Figure 1:
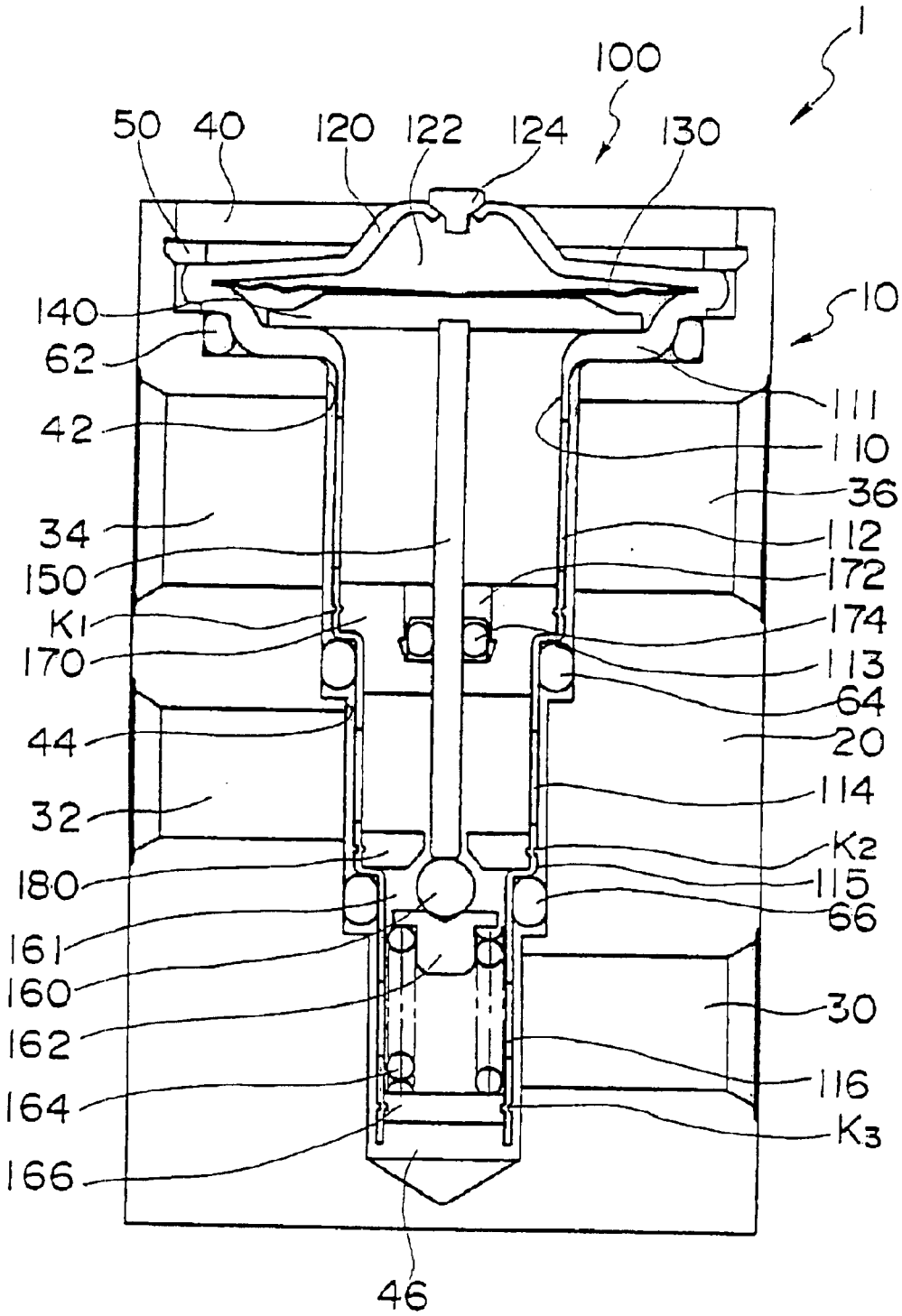
FIG. 1 is a cross-sectional view showing the overall structure of the expansion valve according to the present invention.

FIG. 1 is a cross-sectional view showing one preferred embodiment of an expansion valve with a cassette structure according to the present invention.

The expansion valve, the whole structure of which being designated by reference number 1, comprises a piping member 10 and a cassette unit 100 formed as separate components.

The piping member 10 has a body 20 formed of an appropriate material such as aluminum, and to the body are provided a path 30 to which a piping of a refrigerant supplied from a compressor not shown is connected, a path 32 to which a piping of a refrigerant traveling toward an evaporator (not shown) is connected, a path 34 to which a piping of a refrigerant returning from the evaporator is connected, and a path 36 to which a piping of a refrigerant returning to the compressor is connected.

At the center of the body 20 in the direction orthogonal to the refrigerant paths are provided bore portions 40, 42, 44 and 46 with steps. The bore portion 46 constitutes a hole with a bottom.

The cassette unit 100 accommodated in the bore portion formed to the body 20 of the piping member 10 comprises a tube member 110 formed by drawing stainless steel material and the like. The tube member 110 is formed integrally with a flange portion 111, and provided with step portions 113 and 115. The end of the tube member 110 opposite from the flange portion 113 is opened.

A stopper 140 is disposed in the flange portion 111, and a diaphragm 130 comes into contact with the upper surface of the stopper 140. The circumference of the diaphragm 130 is sandwiched by a lid member 120 and the flange portion, and the lid member 120 is welded integrally thereto. The lid member 120 and the diaphragm 130 define a gas charge chamber 122, which is filled with a predetermined gas and sealed with a plug 124. The gas charge chamber 122 and the diaphragm 130 constitute the driving mechanism of the valve member.

The tube member 110 is provided with through holes 112, 114 and 116 through which refrigerant travels. A shaft member 150 comes into contact with the lower surface of the stopper 140, the shaft member 150 passing through the guide member 170 and the orifice member 180, reaching a valve member 160 disposed within a valve chamber 161.

The spherical valve member 160 is supported by a support member 162, the support member 162 further supported via a spring 164 by a fixed plate 166. The fixed plate 166 is disposed at the lower end of the tube member 110, and defines the valve chamber 161.

A seal member 174 is inserted to the guide member 170 and fixed thereto by a support member 172. The seal member 174 guides the shaft member 150 and seals any leak of refrigerant between the refrigerant path 32 leading to the evaporator and the refrigerant path 34 returning from the evaporator. The guide member 170 is fixed to the tube member 110 through a caulking portion $K_1$. Furthermore, the orifice member 180 and the fixed plate 166 are also fixed to position by caulking portions $K_2$ and $K_3$, respectively.

The cassette unit 100 is inserted to the bore portion of the body 20 of the piping member 10 and fixed thereto by a stop ring 50. Three seal members 62, 64 and 66 are fit between the cassette unit 100 and the bore portion of the body 20, forming a seal between the outer periphery of the cassette unit 100 and the bore portion of the body 20 of the piping member 10.

According to this structure, the temperature of the low-pressure refrigerant passing through the refrigerant path 34, 36 from the evaporator toward the compressor is transmitted to the gas charge chamber 122 via the shaft member 150 and the stopper 140, by which the pressure of the refrigerant filled in the gas charge chamber 122 changes, and this change in pressure is transmitted via the diaphragm 130 and the shaft member 150 to the valve member 160, driving the valve member 160 to a position in which the vapor pressure variation, the bias force of the spring 164 and the refrigerant pressure within paths 34 and 36 are balanced, and controlling the amount of refrigerant supplied from the compressor and passing the path 30 toward the evaporator.

Since a clearance is provided between the outer diameter of the tube member 110 of the cassette unit 100 and the bore portion of the body 20 of the piping member 10, the paths 30, 32, 34 and 36 formed to the piping member 10 can be designed with great freedom.

Thus, the degree of freedom of the piping structure is improved, and the layout of the air conditioner can be set arbitrarily.

The cassette unit 100 by itself is equipped with all the functions of the expansion valve.

The piping member 10 exerts its function by comprising paths that can connect the refrigerant piping to the cassette unit 100 having the function of the expansion valve, so the shapes and structures of the paths can be designed freely.

However, the seal structure of the refrigerant provided between the cassette unit 100 and the piping member 10 must have a secure and reliable sealing capability.

On the other hand, the tube member 110 of the cassette unit 100 is manufactured by drawing a stainless steel material, so various structures can be employed considering its drawability.

Figure 2:
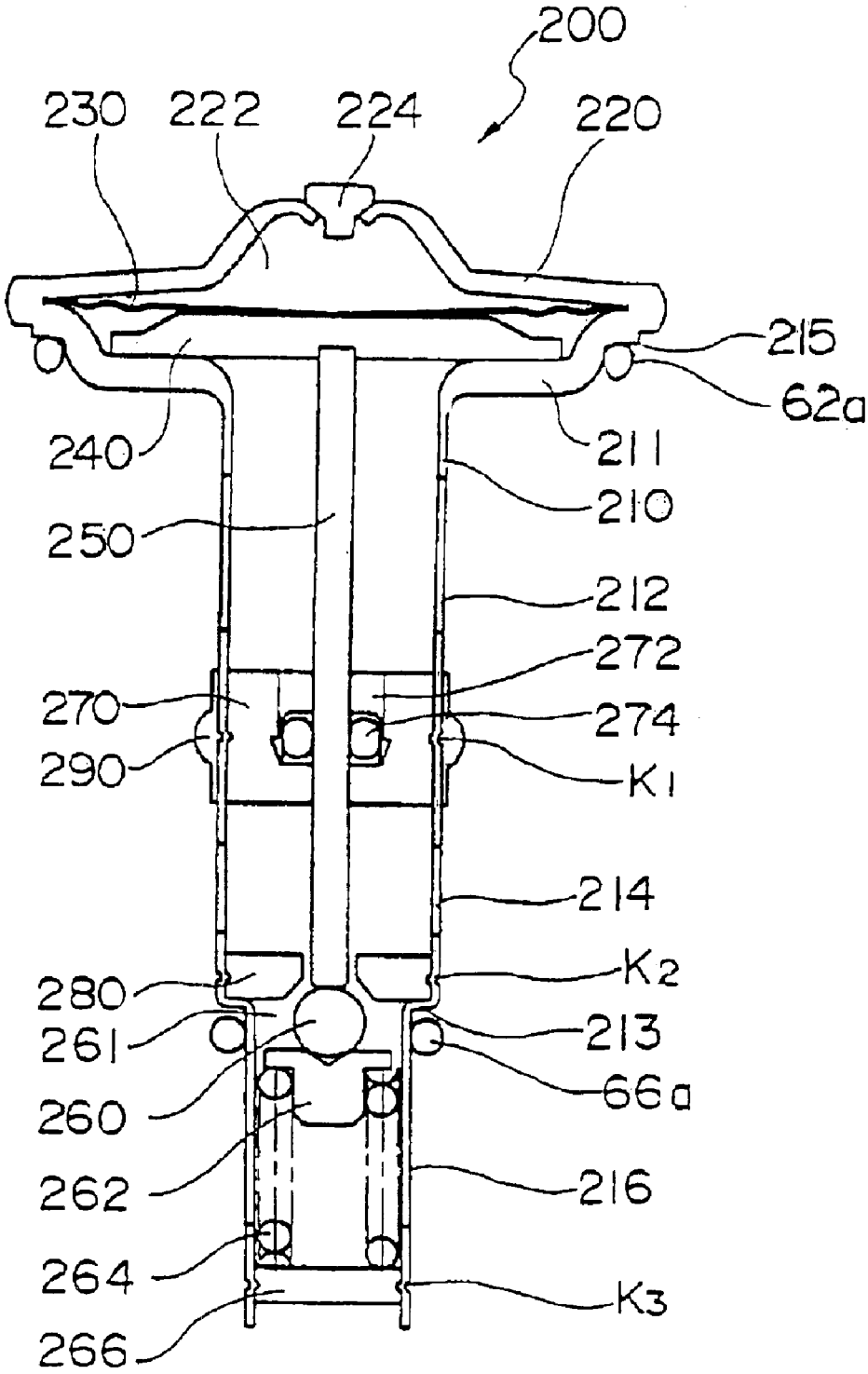
FIG. 2 is a cross-sectional view showing another example of the cassette unit of the expansion valve according to the present invention.

FIG. 2 is a cross-sectional view showing another preferred embodiment of the cassette unit of the present invention.

Compared to the structure shown in FIG. 1, the present embodiment adopts a structure with less step portions. The cassette unit shown as a whole by reference number 200 in FIG. 2 comprises a flange portion 211 and an integrally formed tube member 210, the tube member 210 having a step portion 213 and through-holes 212, 214 and 216 through which refrigerant passes.

A stopper 240 is disposed in the flange portion 211, and a diaphragm 230 comes into contact with the upper surface of the stopper 240. The circumference of the diaphragm 230 is sandwiched by a lid member 220, which is welded to the flange portion. The lid member 220 and the diaphragm 230 define a gas charge chamber 222, which is filled with a predetermined gas and sealed with a plug 224.

A shaft member 250 comes into contact with the lower surface of the stopper 240, the shaft member 250 passing through the guide member 270 and the orifice member 280 and reaching a valve member 260 disposed within a valve chamber 261. The orifice member 280 is fixed to the tube member 210 by a caulking portion $K_2$.

A spherical valve member 260 is supported by the support member 262, and the support member 262 is supported via a spring 264 by a fixed plate 266. The fixed plate 266 is fixed to the tube member 210 by a caulking portion $K_3$.

A seal member 274 is inserted to the guide member 270, and fixed to position by a support member 272.

The seal member 274 guides the shaft member 250 and seals the leak between the refrigerant traveling toward the evaporator and the refrigerant returning from the evaporator.

The guide member 270 has a cylindrical outer circumference, and is fixed to the cylindrical portion of the tube member 210 by a caulking portion $K_1$. A rubber bush member 290 is fit to the outer circumference of the tube member 210 opposing the guide member 270.

The rubber bush member 290 forms a seal when the cassette unit 200 is inserted to the piping member 10 illustrated in FIG. 1. According to this structure, the flow of refrigerant can be controlled similarly as the example of FIG. 1, but with a tube member 210 having less step portions and thus can be easily formed. When inserting the cassette unit, a seal member 66*a* is mounted on the step portion 213 of the tube member 210 and a seal member 62*a* is mounted on the step portion 215 of the flange portion 211.

According to the present example, the refrigerant flow can be controlled effectively similar to the example of FIG. 1 using a tube member 210 having less steps and thus can be easily formed.

Figure 3:
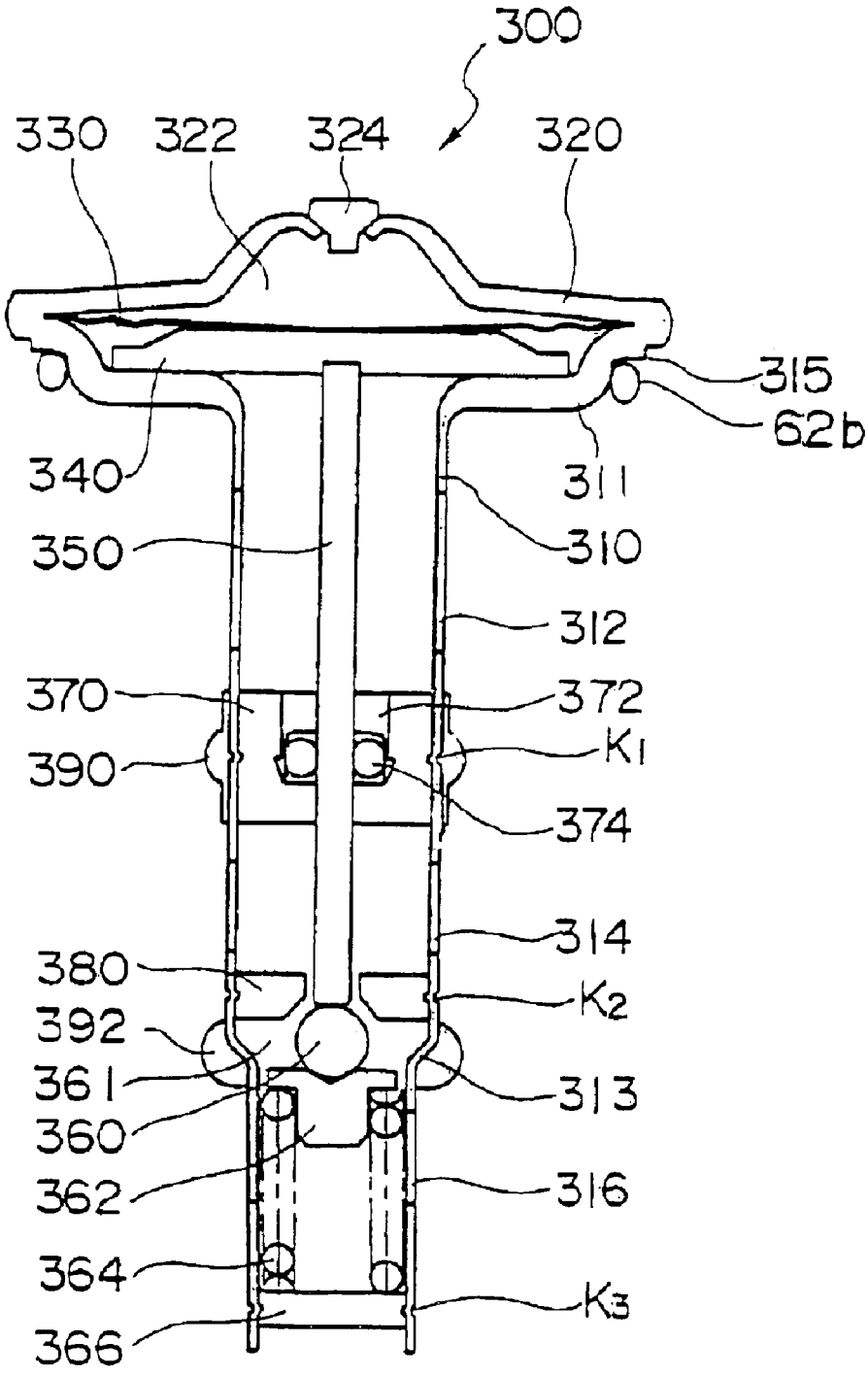
FIG. 3 is a cross-sectional view showing yet another example of the cassette unit of the present expansion valve.

FIG. 3 is a cross-sectional view showing another embodiment of the cassette unit of the present invention.

Of course, the cassette unit of the present embodiment is capable of controlling the flow of refrigerant in a similar manner as the example shown in FIG. 1.

In the drawing, the cassette unit shown as a whole by reference number 300 comprises a flange unit 311 and a tube member 310 which are formed as an integral unit, the tube member 310 having a step portion 313 and through-holes 312, 314 and 316 through which refrigerant travels.

A stopper 340 is disposed in the flange portion 311, and a diaphragm 330 comes into contact with the upper surface of the stopper 340. The circumference of the diaphragm 330 is sandwiched by the flange portion and a lid member 320 which is welded integrally thereto. The lid member 320 and the diaphragm 330 define a gas charge chamber 322, which is filled with a predetermined gas and sealed with a plug 324.

A shaft member 350 comes into contact with the lower surface of the stopper 340, the shaft member 350 passing through the guide member 370 and the orifice member 380 and reaching a valve member 360 disposed within a valve chamber 361. The orifice member 380 is fixed to the tube member 310 by a caulking portion $K_2$.

A spherical valve member 360 is supported by the support member 362, and the support member 362 is supported via a spring 364 by a fixed plate 366. The fixed plate 366 is fixed to the tube member 310 by a caulking portion $K_3$.

A seal member 374 is inserted to the guide member 370, and fixed to position by a support member 372.

The seal member 374 guides the shaft member 350 and seals the leak between the refrigerant traveling toward the evaporator and the refrigerant returning from the evaporator.

The guide member 370 has a cylindrical outer circumference, and is fixed to the cylindrical portion of the tube member 310 by a caulking portion $K_1$. A rubber bush member 390 is fit to the outer circumference of the tube member 310 opposing the guide member 370.

Furthermore, a rubber seal member 392 is fixed to the step portion 313 of the tube member 310 by baking. A seal member 62*b* is fit to the step portion 315 of the flange member 311. The rubber bush member 390 and the seal members 392 and 62*b* create a seal when the cassette unit 300 is inserted to the piping member 10 shown in FIG. 1.

Figure 4:
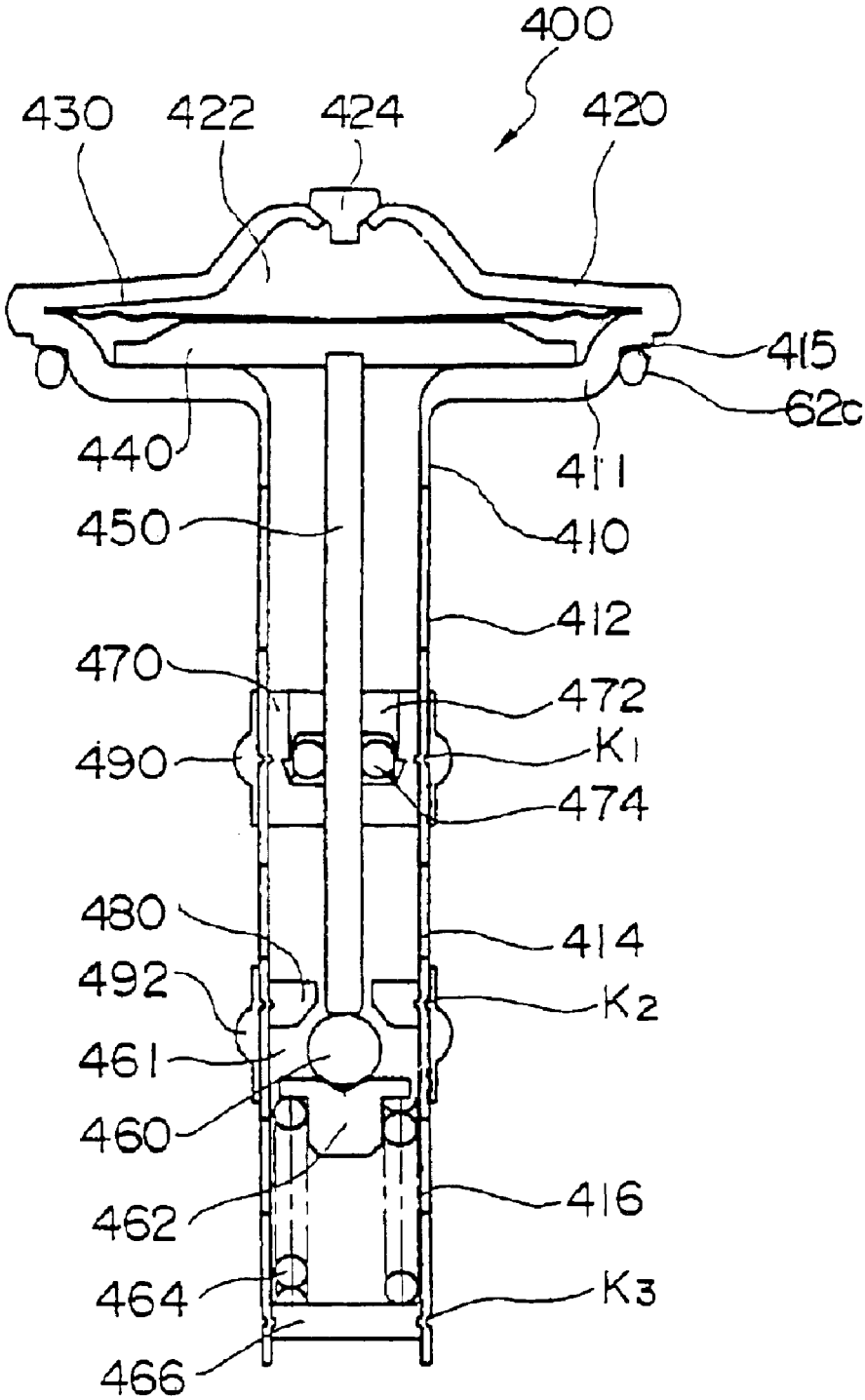
FIG. 4 is a cross-sectional view showing yet another example of the cassette unit of the present expansion valve.

FIG. 4 is a cross-sectional view showing yet another embodiment of the cassette unit according to the present invention.

The cassette unit of the present embodiment comprises a tube member without any step portion, and it is capable of controlling the flow of refrigerant in a similar manner as the example shown in FIG. 1.

In the drawing, the cassette unit shown as a whole by reference number 400 comprises a flange unit 411 and a tube member 410 which are integrally formed, the tube member 410 having a substantially straight cylindrical body with through holes 412, 414 and 416 through which refrigerant travels.

A stopper 440 is disposed in the flange portion 411, and a diaphragm 430 comes into contact with the upper surface of the stopper 440. The circumference of the diaphragm 430 is sandwiched by the flange portion and a lid member 420 which is welded integrally thereto. The lid member 420 and the diaphragm 430 define a gas charge chamber 422 functioning as a heat sensing chamber, which is filled with a predetermined gas and sealed with a plug 424.

A shaft member 450 comes into contact with the lower surface of the stopper 440, the shaft member 450 passing through the guide member 470 and the orifice member 480 and reaching a valve member 460 disposed within a valve chamber 461. The orifice member 480 is fixed to the tube member 410 by a caulking portion $K_2$.

A spherical valve member 460 is supported by the support member 462, and the support member 462 is supported via a spring 464 by a fixed plate 466.

A seal member 474 is inserted to the guide member 470, and fixed to position by a support member 472.

The seal member 474 guides the shaft member 450 and seals the leak between the refrigerant traveling toward the evaporator and the refrigerant returning from the evaporator.

The guide member 470 has a cylindrical outer circumference, and is fixed to the cylindrical portion of the tube member 410 by a caulking portion $K_1$. A rubber bush member 490 is fit to the outer circumference of the tube member 410 opposing the guide member 470.

Further, a rubber bush member 492 is fit to the outer circumference of the valve chamber 461. A seal member 62*c* is mounted to a step portion 415 provided to the flange portion 411. The rubber bush members 490 and 492 and the seal member 62*c* constitute a seal when the cassette unit 400 is inserted to the piping member 10 shown in FIG. 1.

In the embodiment illustrated in FIG. 1, the disk-shaped diaphragm 130 defining the gas charge chamber is sandwiched at its circumference by the lid member 120 and the flange portion 111 and welded thereto, but the present invention is not limited to such example. For example, the periphery of the diaphragm 130 can be raised upward to a determined height, and this rising portion can be sandwiched by the lid portion 120 and the pipe member 110 and welded thereto.

Figure 5:
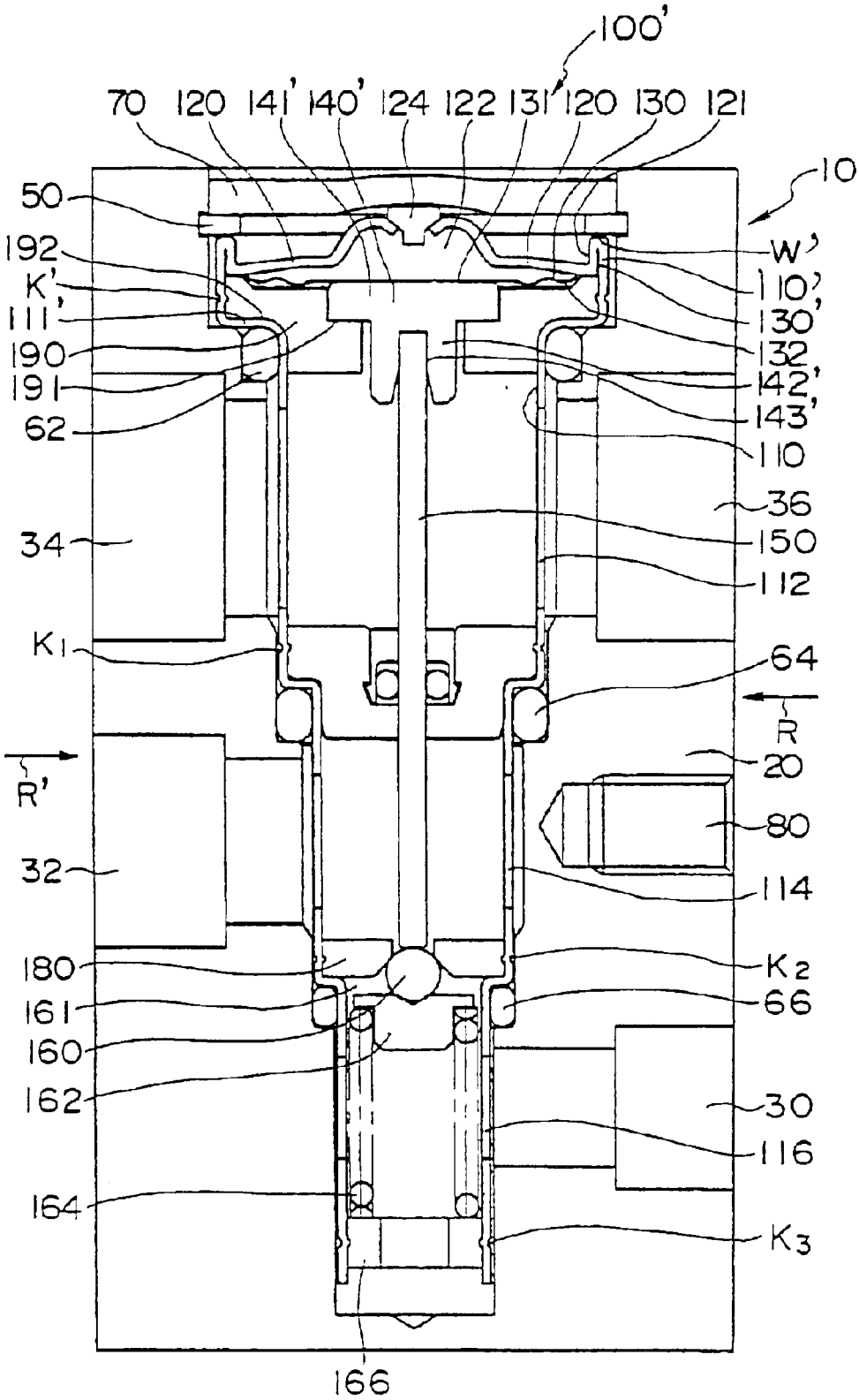
FIG. 5 is a cross-sectional view showing yet another example of the present invention.

FIG. 5 is a cross-sectional view showing another embodiment of the present expansion valve, comprising a diaphragm 130 that has a rising portion which is welded to position. The main difference between the present embodiment and the embodiment of FIG. 1 is that according to the present embodiment, the rising portion of the diaphragm is sandwiched between the lid member and the tube member and welded thereto, so the same components as those appearing in FIG. 1 are provided with the same reference numbers, and detailed explanations thereof are omitted.

In FIG. 5, the diaphragm 130 comprises a rising portion 130' formed to the circumference thereof, which is sandwiched between a rising portion 121 formed to the circumference of the lid member 120 and the upper end 110' of the tube member 110, and welded thereto via a weld portion W'. In this structure, the center area 131 of the diaphragm 130 is in contact with one surface of the stopper member 140', and the portion of the diaphragm from the center 131 to the bent area 132 where the rising portion 130' starts is supported radially by a disk member 190. One surface of the stopper member 140' is a disk-shaped base 141' that is in contact with the diaphragm 130, and the opposite surface of the member 140' from the base has a cylindrical portion 142' formed to the center thereof. A center hole 143' of this cylindrical portion 142' accommodates the upper end of the shaft member 150, the other end of the shaft member 150 being in contact with the valve member 160. The stopper member 140' is supported by a disk member 190 having a step portion. That is, the periphery of the cylindrical portion 142' on said opposite surface of the stopper member 140' is supported by an inner step portion 191 of the disk member 190, and an outer step portion 192 of the disk member is supported by a step portion 111' formed to the tube member 110.

The disk member 190 is made of metal such as stainless steel, and fixed to the tube member 110 via a caulking portion K'. The cassette unit 100' has three seal members 62, 64 and 66 which constitute a seal structure between the inner bore of the body 20 of the piping member 10. The seal member 62 is disposed to the step portion 111' of the tube member 110, and seal members 64 and 66 are disposed to the same positions as those in the embodiment of FIG. 1.

The cassette unit 100' is accommodated in the bore portion of the body 20 of the piping member 10 and fixed thereto via a stop ring 50, but according to the embodiment of FIG. 5, a protection cover 70 made for example of rubber or resin to protect the cassette unit 100' is disposed to contact the plug 124 on the lid member 120.

The lid member 120 and the diaphragm 130 define a gas charge chamber 122, which is sealed by a plug 124. The gas charge chamber 122 and the diaphragm 130 constitute the driving mechanism of the valve member 160 that functions similarly as the embodiment of FIG. 1, according to which the amount of refrigerant supplied from the compressor and traveling through the path 30 toward the evaporator is controlled.

Figure 6:
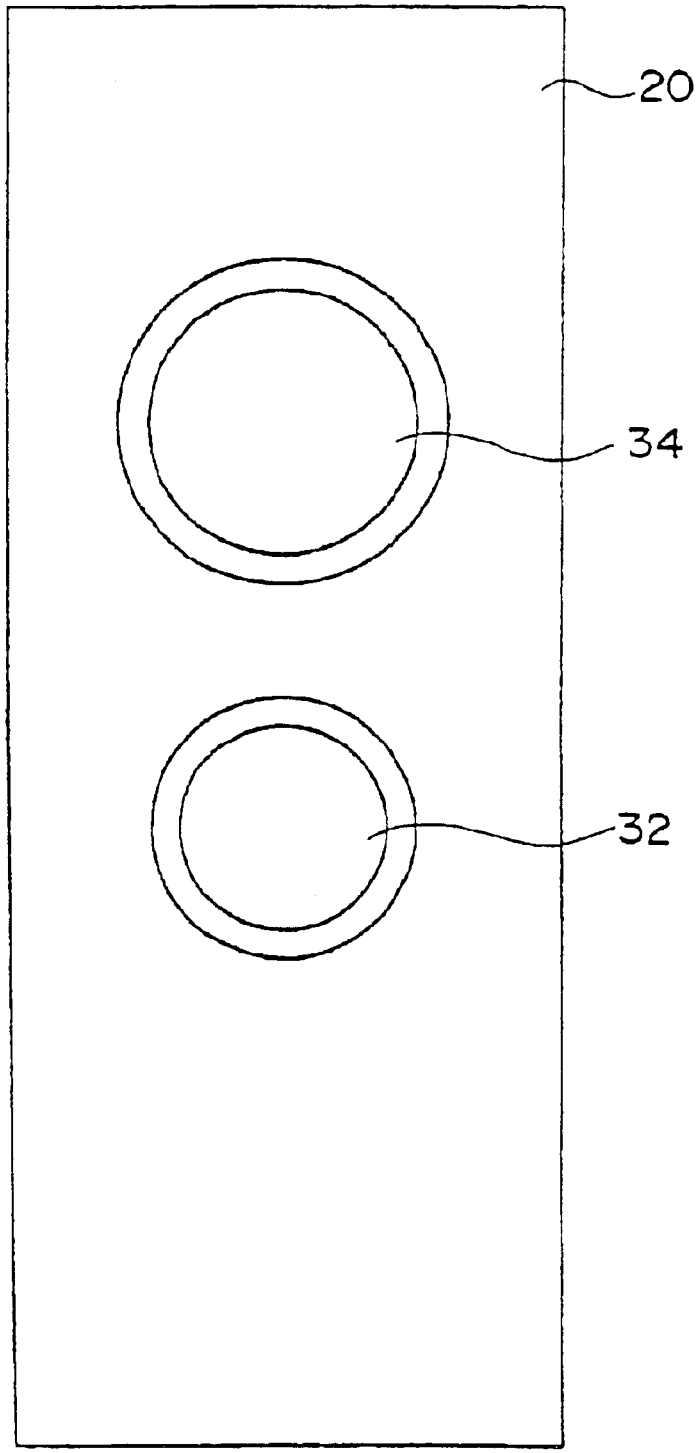
FIG. 6 is a right side view of FIG. 5.
Figure 7:
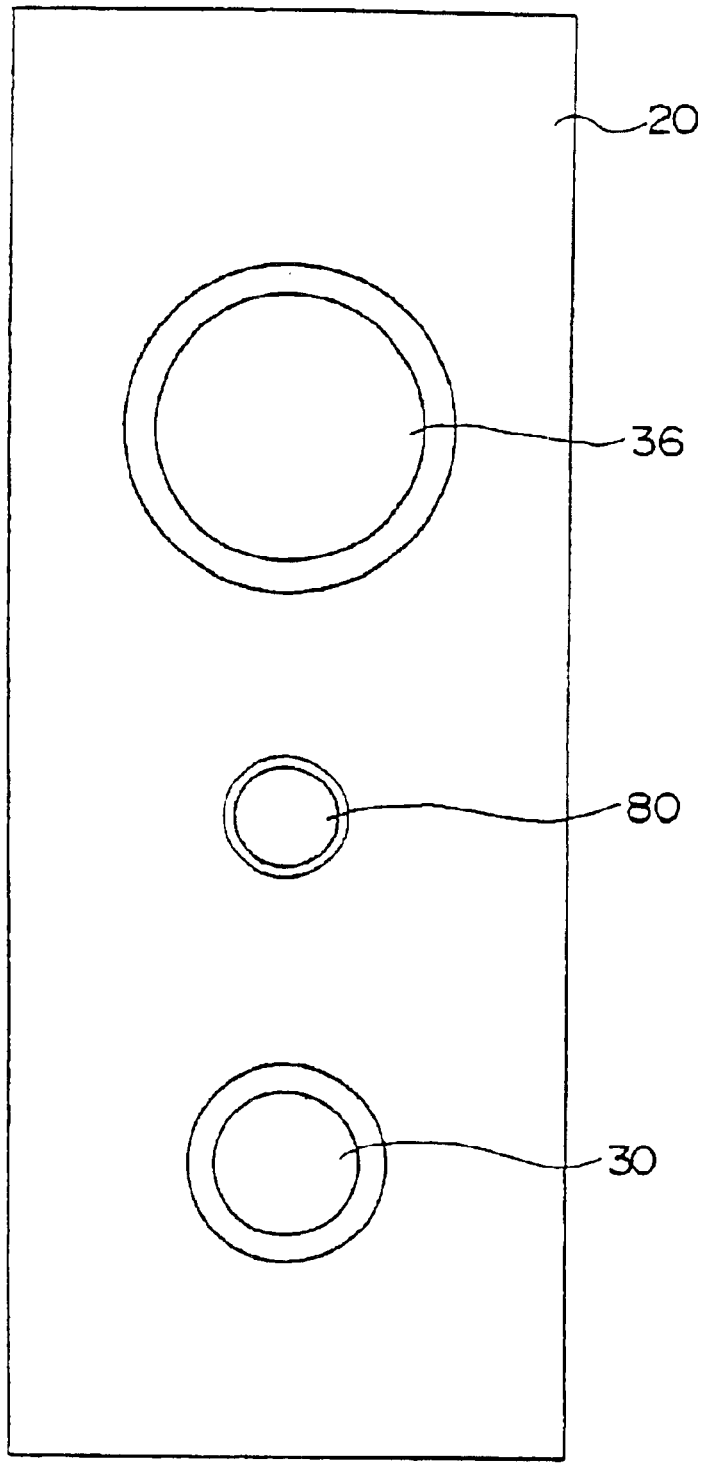
FIG. 7 is a left side view of FIG. 5.

FIGS. 6 and 7 are drawings showing the rectangular outer configuration of the piping member 10 viewed from arrow directions R and R', respectively. In FIG. 5, reference 80 shows a bolt hole formed to the body 20.

According to the embodiment of FIG. 5, the diaphragm 130 is sandwiched between the lid member 120 and the tube member 100' at its rising portion and welded thereto, so the radial size of the diaphragm 130 can be reduced, and thus the driving mechanism of the valve member can be downsized. As a result, the whole cassette unit 100' can be downsized.

Figure 8:
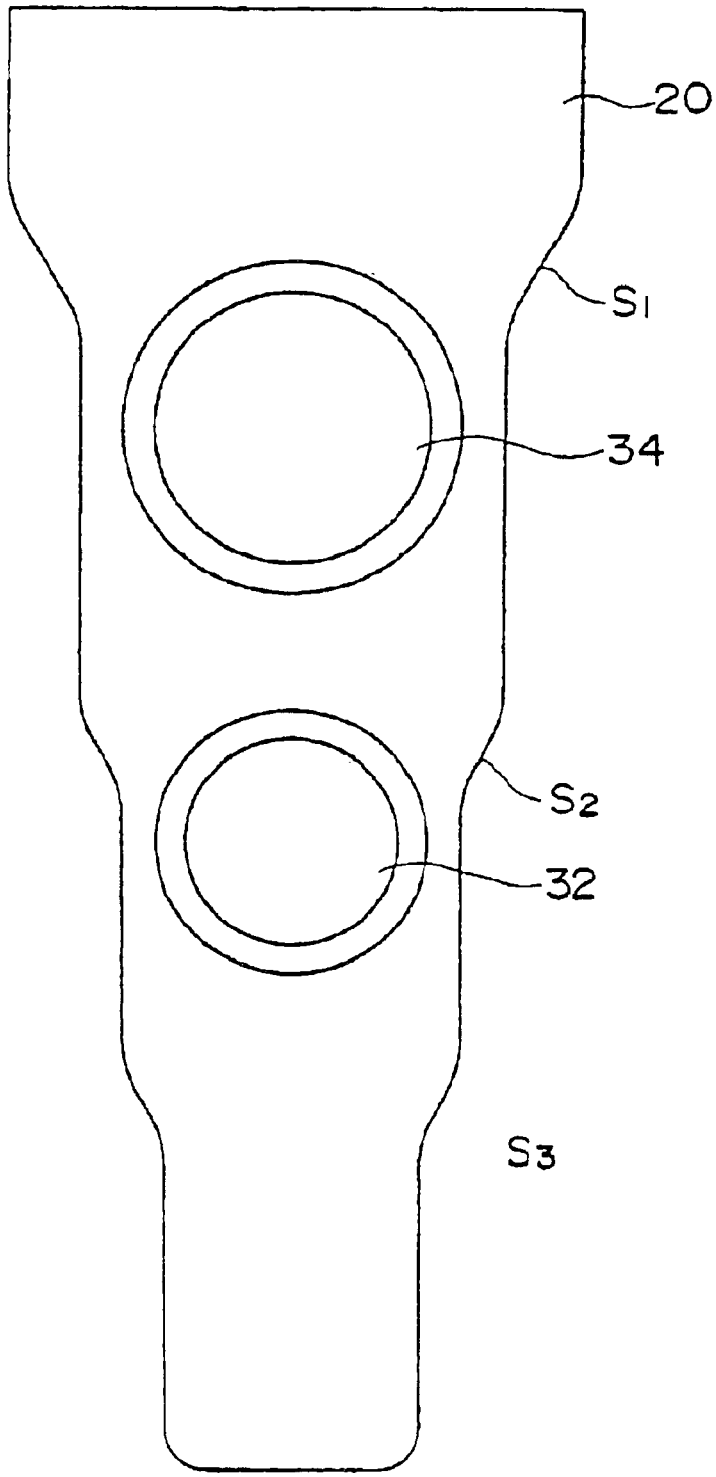
FIG. 8 is a side view similar to FIG. 6 according to another example of the present invention.
Figure 9:
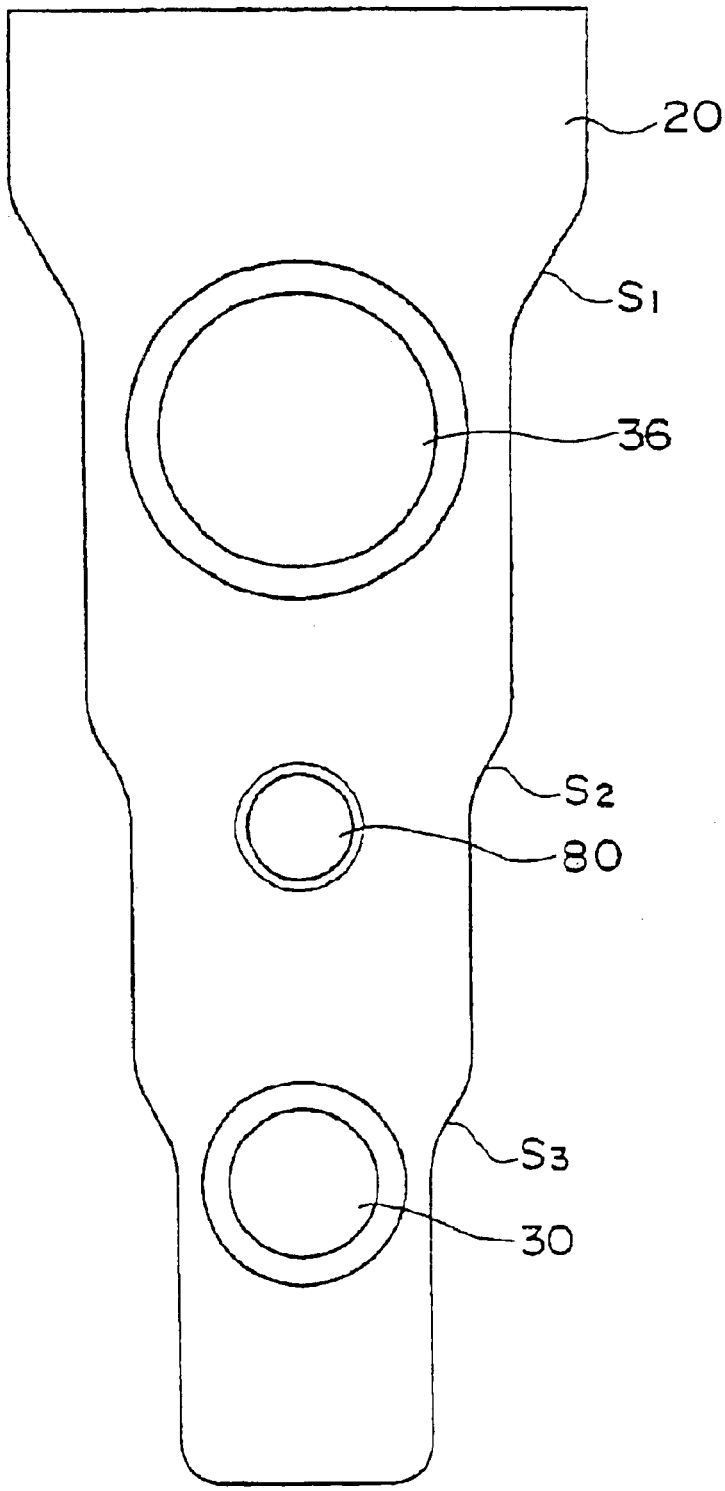
FIG. 9 is a side view similar to FIG. 7 according to another example of the present invention.

Further, FIGS. 8 and 9 show another example of the outer configuration of the piping member 10 viewed from arrow directions R and R' of FIG. 5, respectively, having steps $S_1$ through $S_3$ formed thereto so as to cut down the width of the body 20.

Now, the degree of freedom related to the design of the expansion valve according to the present invention will be explained with reference to FIGS. 10 through 13. In FIGS. 10 through 13, the components equivalent to those shown in FIG. 1 are provided with the same reference numbers, and the explanations thereof are omitted.

Figure 10:
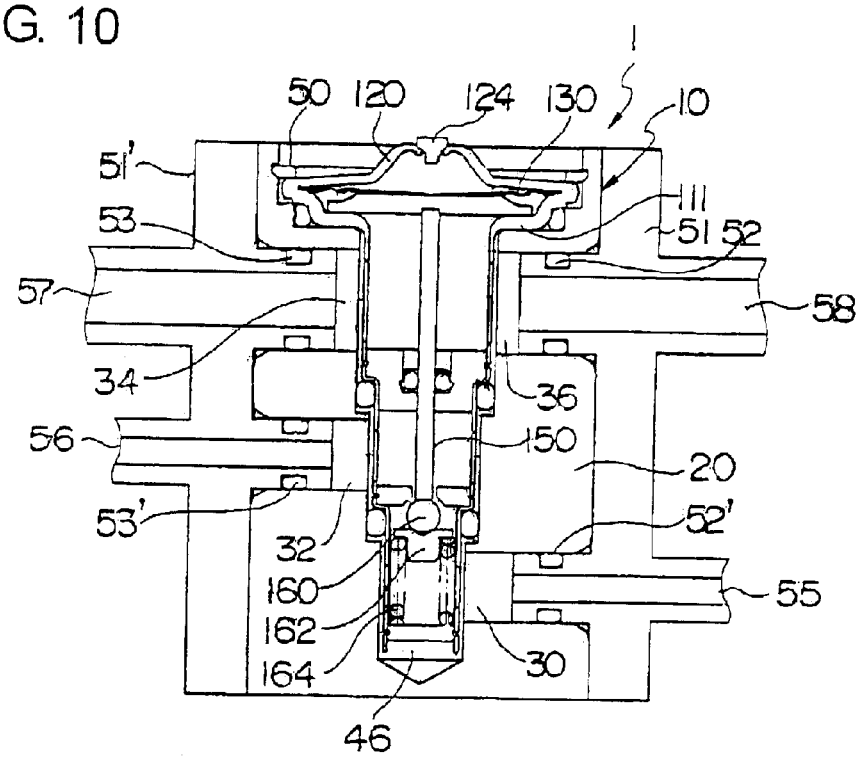
FIG. 10 is a cross-sectional view showing an example of the pipe arrangement of the present expansion valve.
Figure 11:
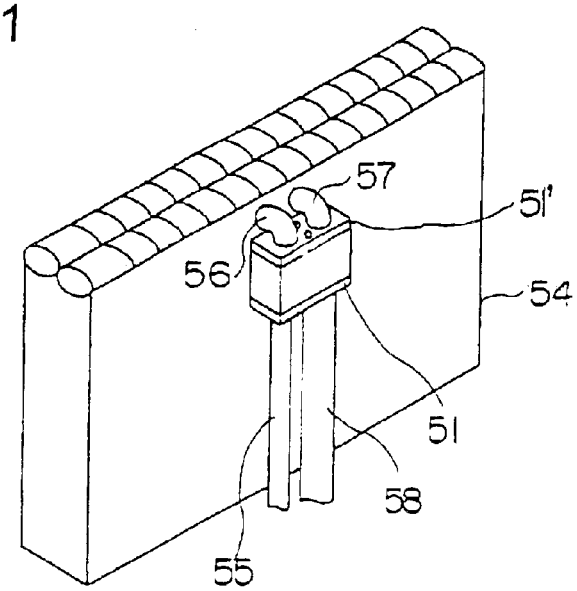
FIG 11 is a cross-sectional view showing an example of the pipe arrangement according to the present expansion valve.

FIG. 10 is a cross-sectional view showing an example of a flange connection adopted in mounting the expansion valve 1 explained in the embodiment of FIG. 1 to an evaporator, wherein flanges 51 and 51' are used to connect the refrigerant piping to the expansion valve 1. In the drawing, flanges 51 and 51' are assembled to the body 20 of the piping member 10 of the expansion valve 1 in an airtight manner via o-rings 52, 52' and o-rings 53, 53'. FIG. 11 illustrates how the expansion valve 1 is connected to the evaporator through this flange connection.

FIG. 11 is a drawing showing a sketch of how the expansion valve 1 shown in FIG. 1 is connected to an evaporator 54, wherein the refrigerant from a compressor not shown is introduced through a pipe 55 to the refrigerant path 30, then through the refrigerant path 32 and via a pipe 56 to the evaporator 54, and the refrigerant passing through the evaporator 54 and exiting therefrom travels through a pipe 57 into the refrigerant path 34, then through the refrigerant path 36 and via a pipe 58 toward the compressor. Each of the pipes 55 through 58 are connected to the flanges 51 and 51' by insertion or press fit. The pipes can also be formed integrally with the flanges.

Figure 12:
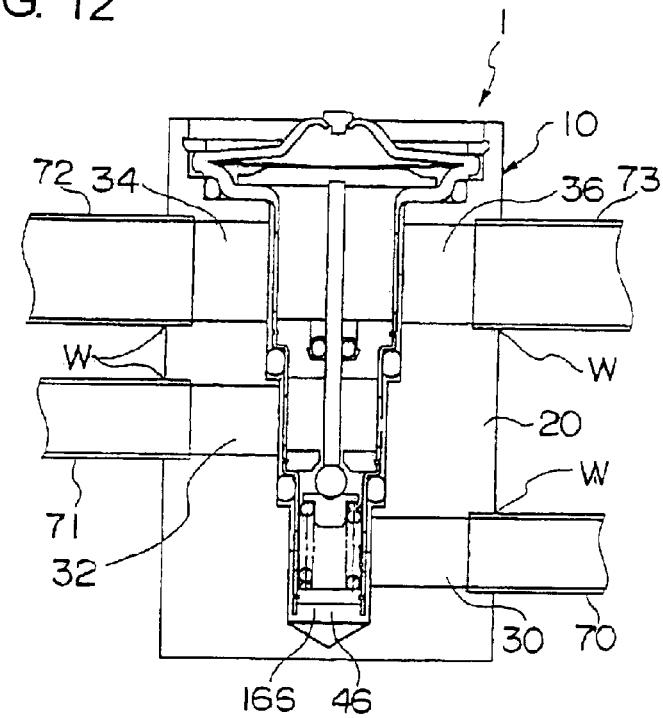
FIG. 12 is a cross-sectional view showing an example of the pipe arrangement of the present expansion valve.
Figure 13:
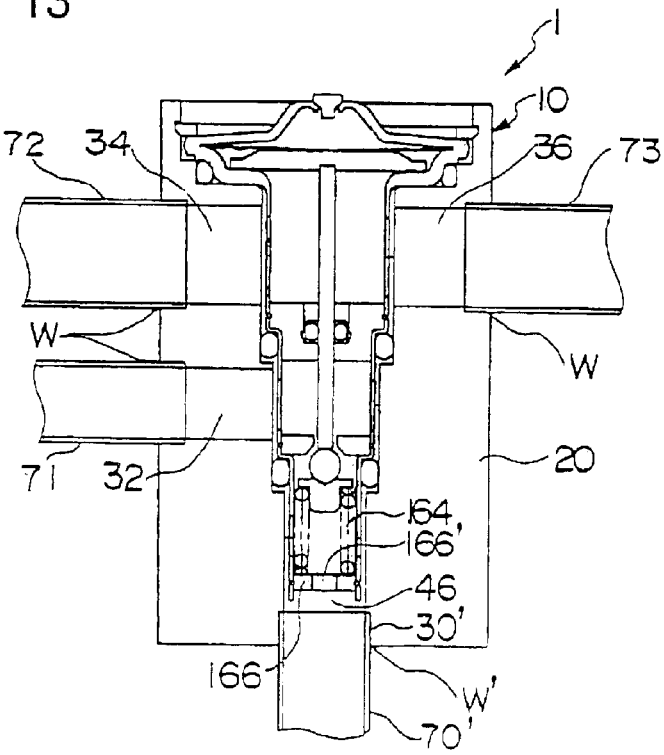
FIG. 13 is a cross-sectional view showing another example of the pipe arrangement of the present expansion valve.

FIGS. 12 and 13 show examples of how pipes are connected to the expansion valve 1 shown in the embodiment of FIG. 1, wherein the pipes are directly welded onto the body 20 of the piping member 10. In FIG. 12, pipes 70, 71, 72 and 73 made for example of aluminum are respectively connected to refrigerant paths 30, 32, 34 and 36 formed to the piping member body 20, and fixed thereto at weld areas W.

FIG. 13 shows an example of a pipe connection similar to what is shown in FIG. 12 but with the pipe 70 connected to the bore portion 46, wherein the piping member body 20 comprises a refrigerant path 30' into which refrigerant from a compressor is supplied and leading to the bore portion 46. A pipe 70' is welded onto the path 30' via a weld area W', by which the pipe is fixed to the piping member body 20. According to the example of FIG. 9, a through-hole 166' is provided to the plate member 166.

The embodiment illustrated in FIG. 1 is applied to FIGS. 10 through 12 for explanation, but the embodiment illustrated in FIGS. 5 through 9 can also be applied thereto.

As explained, the expansion valve according to the present invention characterizes in forming as separate members a piping member to which pipes communicating the expansion valve with various components of the air conditioning device are connected and a cassette unit inserted to the piping member and having the functions of the expansion valve, and assembling the two members to form the expansion valve.

The method for connecting the refrigerant pipes to the piping member and the direction of the refrigerant paths formed to the piping member can be selected freely according to the layout of the air conditioner to which the present expansion valve is applied, so according to the present invention, the degree of freedom of the design of the expansion valve is improved.

According to the present invention, the cassette unit structure can be simplified and the overall cost can be cut down.

What is claimed is:

1. An expansion valve to be equipped in an air conditioner to control the flow of a refrigerant, comprising:

a piping member having a bore extending along a longitudinal axis and into but not completely through the piping member and having a first refrigerant path portion, a second refrigerant path portion and a third refrigerant path portion extending transversely to the longitudinal axis and in communication with the bore;

a cassette unit inserted into the bore of the piping member;

the cassette unit comprising a tube member formed integrally with a flange member, the tube member having an interior surface defining a hollow interior of the tube member and at least a first through hole, a second through hole, a third through hole and a fourth through hole; a guide member, an orifice member and a plate member fixed to the interior surface of the tube member; a valve member disposed within a valve chamber defined, in part, by the orifice member; a plate member defining, in part, the valve chamber; a spring disposed between the plate member and the valve member and biasing the valve member toward the orifice member; a shaft member for driving the valve member; a lid member welded onto the flange member; a diaphragm sandwiched between the lid member and the flange member and defining a gas charge chamber; and a stopper for transmitting a displacement of the diaphragm to the shaft member;

a ring for fixing to the piping member the lid member of the cassette unit inserted to the piping member; and a first seal member and a second seal member, the first and second seal members being disposed between an outer diameter of the cassette unit and an inner diameter of the piping member, wherein the guide member and the stopper are disposed apart from one another in a facially-opposing relationship to define, at least in part, a first refrigerant flow-through chamber of the tube member being in fluid communication with the first refrigerant path portion via the first and second through holes;

the guide member and the orifice member are disposed apart from one another in a facially-opposing relationship to define, at least in part, a second refrigerant flow-through chamber of the tube member being in fluid communication with the second refrigerant path portion via the third through hole; and the orifice member and the plate member are disposed apart from one another in a facially-opposing relationship to define, at least in part, the valve chamber in fluid communication with the third refrigerant path portion via the fourth through hole.

2. An expansion valve according to claim 1, wherein the axis of the refrigerant path formed to the piping member is designed according to the layout of the piping.

3. An expansion valve according to claim 1, further comprising a rubber bush disposed to the outside of the tube member.

4. An expansion valve according to claim 1, further comprising a rubber seal member baked onto the outside of the tube member.

5. An expansion valve according to claim 1, wherein the guide member, the orifice member and the plate member are crimped to the tube member.

6. An expansion valve to be equipped in an air conditioner to control the flow of a refrigerant, comprising:

a piping member having a bore extending along a longitudinal axis and into but not completely through the piping member and having a first refrigerant path portion, a second refrigerant path portion and a third refrigerant path portion extending transversely to the longitudinal axis and in communication with the bore;

a cassette unit inserted into the bore of the piping member;

the cassette unit comprising a tube member having an interior surface defining a hollow interior of the tube member and at least a first through hole, a second through hole, a third through hole and a fourth through hole; a guide member, an orifice member and a plate member fixed to the interior surface of the tube member; a valve member disposed within a valve chamber defined, in part, by the orifice member; a plate member disposed at the lower end of the tube member and defining, in part, the valve chamber; a spring disposed between the plate member and the valve member and biasing the valve member toward the orifice member; a shaft member for driving the valve member; a lid member having a raised portion welded onto the tube member; a diaphragm sandwiched between the raised portion and the upper end of the tube member and defining a gas charge chamber; and a stopper for transmitting a displacement of the diaphragm to the shaft member;

a ring for fixing to the piping member the lid member of the cassette unit inserted to the piping member; and a first seal member and a second seal member, the first and second seal members being disposed between an outer diameter of the cassette unit and an inner diameter of the piping member, wherein the guide member and the stopper are disposed apart from one another in a facially-opposing relationship to define, at least in part, a first refrigerant flow-through chamber of the tube member being in fluid communication with the first refrigerant path portion via the first and second through holes;

the guide member and the orifice member are disposed apart from one another in a facially-opposing relationship to define, at least in part, a second refrigerant flow-through chamber of the tube member being in fluid communication with the second refrigerant path portion via the third through hole; and the orifice member and the plate member are disposed apart from one another in a facially-opposing relationship to define, at least in part, the valve chamber in fluid communication with the third refrigerant path portion via the fourth through hole.

7. An expansion valve according to claim 6, wherein the axis of the refrigerant path formed to the piping member is designed according to the layout of the piping.

8. An expansion valve according to claim 6, further comprising a rubber bush disposed to the outside of the tube member.

9. An expansion valve according to claim 6, further comprising a rubber seal member baked onto the outside of the tube member.

10. An expansion valve according to claim 6, wherein the guide member, the orifice member and the plate member are crimped to the tube member.

11. An expansion valve according to claim 1, wherein the cassette unit is inserted into the bore of the piping member in a non-contacting yet close-fitting relationship at least along the tube member.

12. An expansion valve according to claim 11, wherein the first seal member causes the first refrigerant flow-through chamber and the first refrigerant path portion to be in fluid isolation from the second refrigerant flow-through chamber and second refrigerant path portion exteriorly of the tube member and the second seal member causes the second refrigerant flow-through chamber and second refrigerant path portion to be in fluid isolation from the valve chamber exteriorly of the tube member.

13. An expansion valve according to claim 6, wherein the cassette unit is inserted into the bore of the piping member in a non-contacting yet close-fitting relationship at least along the tube member.

14. An expansion valve according to claim 13, wherein the first seal member causes the first refrigerant flow-through chamber and the first refrigerant path portion to be in fluid isolation from the second refrigerant flow-through chamber and second refrigerant path portion exteriorly of the tube member and the second seal member causes the second refrigerant flow-through chamber and second refrigerant path portion to be in fluid isolation from the valve chamber exteriorly of the tube member.

* * * * *